United States Patent [19]

Mortensen

[11] Patent Number: 4,659,123

[45] Date of Patent: Apr. 21, 1987

[54] RECEPTACLE FOR ASH REMOVAL

[76] Inventor: Bruce Mortensen, 609 W. 1200 South, Vernal, Utah 84078

[21] Appl. No.: 835,721

[22] Filed: Mar. 3, 1986

[51] Int. Cl.[4] ..... F23J 1/00

[52] U.S. Cl. ..... 294/9; 126/243; 294/55

[58] Field of Search ..... 294/9, 10, 49, 55, 57; 15/257.1, 257.3, 257.6, 257.7; 110/166; 126/242–245; 209/417–418; 220/1 T, 2, 260, 262, 263, 270, 334

[56] References Cited

U.S. PATENT DOCUMENTS

| | | | |
|---|---|---|---|
| 332,527 | 12/1885 | Hofer et al. | 126/243 |
| 507,826 | 10/1893 | Miller | 294/55 |
| 879,622 | 2/1908 | Galvin | 126/242 |
| 1,121,093 | 12/1914 | Harvey | 15/257.6 |
| 1,225,989 | 5/1917 | Miller | 220/2 |
| 1,487,400 | 3/1924 | Pope | 126/243 |
| 1,762,912 | 6/1930 | Cleveland | 294/55 |
| 3,063,174 | 11/1962 | Ludin | 294/55 X |
| 4,299,419 | 11/1981 | Kalan | 294/9 X |
| 4,381,761 | 5/1983 | Foxen | 126/243 |

FOREIGN PATENT DOCUMENTS

| | | | |
|---|---|---|---|
| 336992 | 5/1921 | Fed. Rep. of Germany | 294/55 |

*Primary Examiner*—Johnny D. Cherry

*Attorney, Agent, or Firm*—Mallinckrodt & Mallinckrodt

[57] ABSTRACT

A receptacle for removing ashes from a fireplace or stove has a box-like receptacle body strongly constructed of relatively thin gauge sheet steel with a top opening and hinged cover therefor. A long handle is secured to a front panel wall of the receptacle body midway of the width thereof be a relatively narrow, weight-distributing plate to which it is secured adjacent the upper end thereof. The ash-filled receptacle is cantilevered at a distance from a person carrying the same by holding the remote end of the handle.

7 Claims, 3 Drawing Figures

RECEPTACLE FOR ASH REMOVAL

BACKGROUND OF THE INVENTION

1. Field

The invention is in the field of receptacles for removing ashes from fireplaces and stoves, particularly receptacles of box-like configuration that are normally closed to prevent scattering of ashes that are being removed.

2. State of the Art

Many receptacles of the general type concerned have been developed heretofore. Those shown in U.S. Pat. Nos. 332,527; 1,121,093; and 4,381,761 are examples. Others, such as those shown in U.S. Pat. Nos. 4,214,784; 4,299,419; 4,305,376; and 4,457,548, are constructed to both contain the ashes for removal and to scoop them into the receptacle as it is inserted into the fireplace or stove.

BRIEF SUMMARY OF THE INVENTION

The present invention is not concerned with scooping the ashes up by means of the receptacle itself, since shoveling of the ashes into the receptacle is believed to be more efficient and can be done without scattering ashes outside the fireplace or stove in which an open damper insures a draft that will draw off any airborne ash.

What was of concern in the making of the invention was construction of a relatively lightweight receptacle having a long handle for manipulation at a distance from the interior of the fireplace or stove and having adequate strength to support the weight of a full load of ashes without damaging structural deformation thereof but with enhancement of the sealing effectiveness of the cover which closes the loading and unloading opening of the container.

These advantages over known ash removal receptacles were achieved by using relatively thin sheet metal, e.g. 22 gauge sheet steel, for receptacle and closure walls and by attaching an elongate handle to the front panel wall of the box-like receptacle body by means of a relatively narrow plate that extends substantially from bottom to top of such front panel wall, the handle being secured to such plate adjacent to its upper end. The cover forms part of the top panel wall of the receptacle body and, in the preferred form of the invention, is hingedly secured thereto with an overhanging rim that fits tightly against the side and front panel walls of the receptacle body when the cover is closed. If the cover is hinged to a sidewall instead, a rearward coplaner extension thereof equivalent to the rim is provided to cover the joinder crack with the top panel wall of the receptacle body. Part of the overhanging rim at the handle plate location in both instances is desirably bent upwardly as a finger-hold for use in opening and closing the cover.

Constructed in this way the weight of the ashes in the receptacle, cantilevered as they are from the holding end of the elongate handle, have been found to cause a slight temporary deformation of the relatively light sheet metal that effectively enhances the sealing action of the cover against the receptacle body.

THE DRAWING

Illustrated in the accompanying drawing are embodiments of the invention constituting what is presently contemplated as the best mode of carrying it out in actual practice.

In the drawing:

FIG. 1 is a view in perspective looking from above one side and the front of an embodiment wherein the cover is hinged to the top panel of the receptacle body, intermediate portions of the elongate handle and of the cover panel being broken out for convenience of illustration, and hidden parts being shown by broken lines;

FIG. 2, a vertical section taken on the line 2—2 of FIG. 1 and drawn to a larger scale, intermediate portions being broken out for convenience of illustration; and FIG. 3, a fragmentary portion of a view similar to that of FIG. 1, but showing an embodiment in which the cover is hinged to the upper edge of a side wall panel of the receptacle body.

DETAILED DESCRIPTION OF THE ILLUSTRATED EMBODIMENTS

Figure 1:
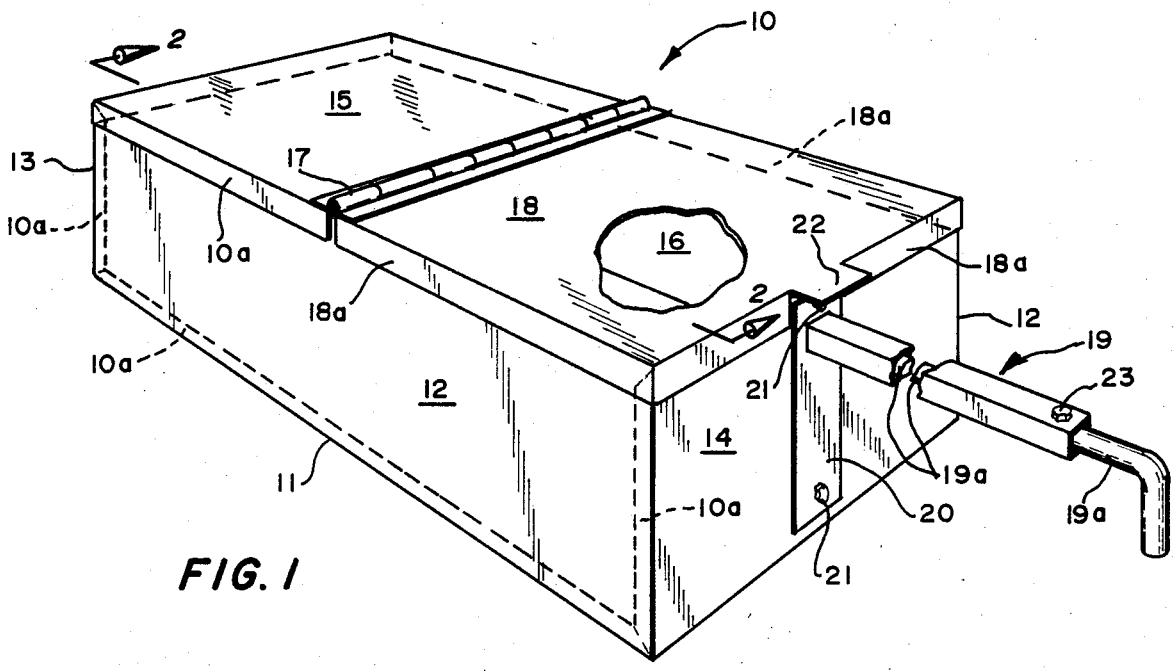
Figure 2:
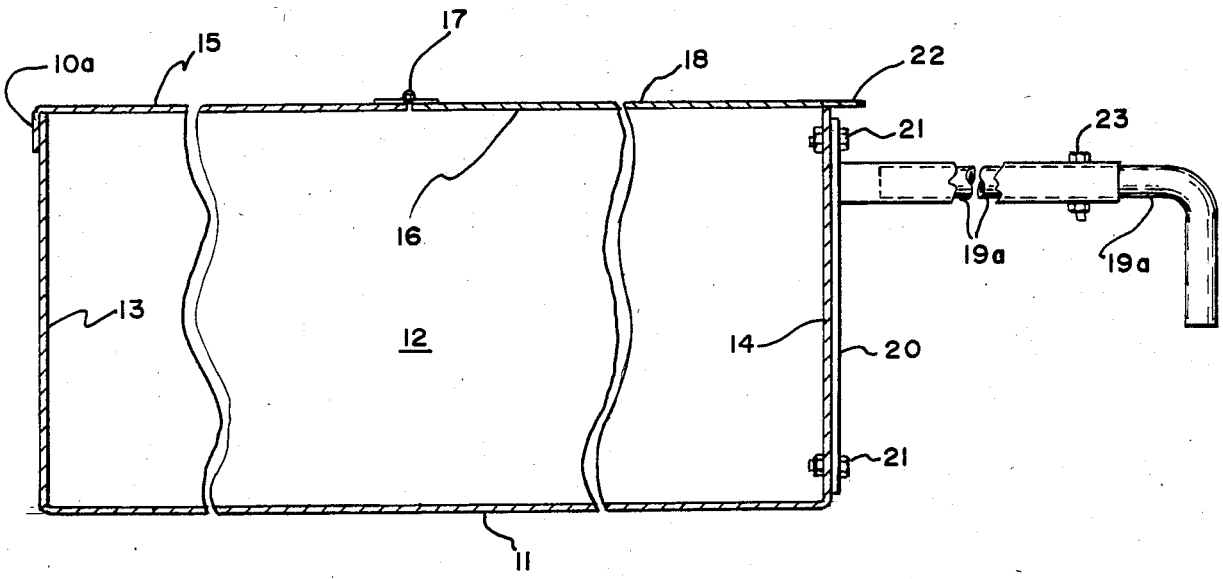

As illustrated in FIGS. 1 and 2, the receptacle of the invention comprises a rectangular, box-like, receptacle body 10 having a bottom panel wall 11, side panel walls indicated at 12, respectively, rear panel wall 13, front panel wall 14, and partial top panel wall 15, leaving a top opening 16 for filling and emptying the otherwise closed receptacle body 10.

Receptacle body 10 is made of relatively thin sheet metal, e.g. twenty-two gauge, which is laid out as blanks having tab margins 10*a* for bending and spot welding to overlying or underlying panel walls in the fabrication of a structurally strong ash container.

Secured to the forward edge margin of partial top panel wall 15, as by means of a piano-type hinge 17, is a cover panel 18 for opening 16. Such cover panel is provided with a rim 18*a* that extends around all but its hinged edge and overhangs receptacle body 10 for making a tight fit against the outer wall faces thereof when the cover is closed.

For holding the receptacle at a distance from the fireplace or stove after ashes have been shoveled into receptacle body 10 through uncovered opening 16 and after cover 18 has been closed tightly, so as to remove the ashes without scattering, a long handle 19 is secured midway of the width of front panel wall 14 and extends forwardly therefrom. Securement is effected by a relatively narrow steel plate 20 that extends substantially from bottom to top of front wall panel 14 in order to distribute the cantilevered load to be carried by means of handle 19.

Handle 19 must be stiff and strong, so is desirably made, at least in large part, from a length of steel tube polygonal in cross-section. Steel tubing of eighteen gauge has been found adequate for the purpose. One end is secured to plate 20 adjacent to its upper end as by welding along substantially its entire periphery.

Plate 20 is advantageously secured to front panel wall 14 of receptacle body 10 by bolts 21 at top and bottom.

To provide a finger-hold 22 for facilitating the opening and closing of cover 18, a portion of rim 18*a* overhanging front panel wall 14 at and preferably equivalent in width to handle plate 20 is cut at each side and bent upwardly.

Handle 19 may be provided with a removable extension 19*a* if desired, so that the permanently affixed steel tube can be short enough to permit convenient packing of the device for sale or moving from one place to another. Extension 19*a* is desirably a steel rod that fits snugly but slidably into the steel tube. it is removably secured in place by a bolt 23.

A convenient size for the receptacle is length twelve inches, width eight inches, and height five and one-half inches, with the tabs 10*a* being one-half inch in length and opening 16 being about eight inches in length. The overhanging rim 18*a* of cover 18 is satisfactory if it extends one-half inch from the cover panel. Handle tube 19 is preferably square in cross-section and ten inches long, handle extension 19*a* being one-half inch diameter cold rolled steel eleven inches long with its end turned at 90° as shown.

Figure 3:
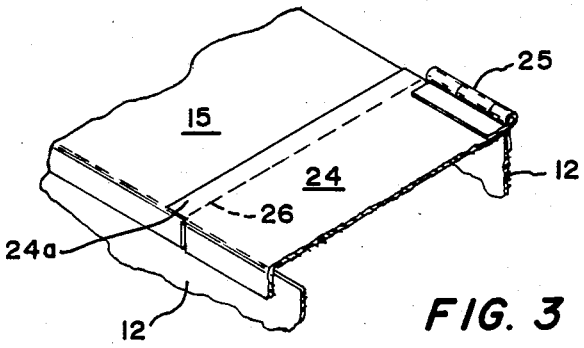

Although the foregoing embodiment is presently preferred, the embodiment of FIG. 3 shows how the cover panel can be hinged to a side panel wall instead of to the partial top panel wall. Here, cover panel 24 is hinged to the upper edge margin of one of the side panel walls 12 by piano-type hinge 25, the overhanging rim of such cover panel being eliminated along the line of hinge and one rim portion, here indicated 24*a*, being coplanar with cover panel 24 and overhanging joinder crack 26 between such cover panel and partial top panel wall 15.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A receptacle for removing ashes from a fireplace or stove while the user is at a distance therefrom, comprising a box-like receptacle body having front, rear, side, bottom, and partial top panel walls forming an enclosure for receiving ashes through a top wall opening; a cover panel of a size that completes the top panel wall of said receptacle body when closed, said cover panel having a rim that overhangs the receptacle body in closed position and fits tightly against adjoining panel walls to largely prevent scattering of ashes when said receptacle is being carried; hinge means hinging said cover panel to said receptacle body for opening and closing said top wall opening; an elongate, stiff handle secured at one end to the front panel wall of the receptacle body and extending forwardly therefrom so that the receptacle body is cantilevered relative to a person at and holding the other end of the handle remote from the receptacle body; and a relatively narrow plate having an upper end portion secured to the said other end of the handle, said plate being secured to the front panel wall of the receptacle body midway of the width thereof and extending substantially from bottom to top of said front panel wall, the walls of said receptacle body being of sheet steel sufficiently thin to enhance sealing of the cover panel when full of ashes and when carried at said other end of the handle remote from said receptacle body, but sufficiently strong to support the load.

2. A receptacle according to claim 1, wherein a portion of the rim of the cover panel overhanging the front panel wall of the receptacle body at the plate is bent upwardly as a finger-hold for raising and lowering said cover panel.

3. A receptacle according to claim 1, wherein the handle comprises a length of stiff steel tubing of polygonal cross-section, an end of which is welded about substantially its entire periphery to the plate.

4. A receptacle according to claim 3, wherein a steel rod handle extension is slidably fitted into said steel tubing from the other end thereof and is removably secured therein.

5. A receptacle according to claim 1, wherein the hinge means joins the cover panel to the top panel wall of the receptacle body.

6. A receptable according to claim 1, wherein the hinge means joins the cover panel to a side panel wall of the receptacle body.

7. A receptacle according to claim 6, wherein a part of the overhanging rim of the cover panel is substantially coplanar with said cover panel and overhangs its joinder with the partial top panel wall of the receptacle body.

* * * * *